US008302996B2

(12) United States Patent
McLain

(10) Patent No.: US 8,302,996 B2
(45) Date of Patent: Nov. 6, 2012

(54) SKI POLE BASKET

(76) Inventor: Mark McLain, Carbondale, CO (US)

( * ) Notice: Subject to any disclaimer, the term of this patent is extended or adjusted under 35 U.S.C. 154(b) by 313 days.

(21) Appl. No.: 12/799,889

(22) Filed: May 4, 2010

(65) Prior Publication Data

US 2011/0272932 A1 Nov. 10, 2011

(51) Int. Cl.
*A63C 11/24* (2006.01)

(52) U.S. Cl. ..... 280/824

(58) Field of Classification Search ..... 280/809, 280/813, 816, 819, 824, 820–823; 135/77–86
See application file for complete search history.

(56) References Cited

U.S. PATENT DOCUMENTS

| | | | | | |
|---|---|---|---|---|---|
| 2,123,437 | A * | 7/1938 | Ring | 280/824 |
| D193,149 | S * | 7/1962 | Bond et al. | D21/775 |
| 3,645,553 | A * | 2/1972 | Hinterholzer | 280/824 |
| 3,743,311 | A * | 7/1973 | Giambazi | 280/824 |
| 4,221,393 | A * | 9/1980 | Donahue | 280/813 |
| 4,343,491 | A * | 8/1982 | Aho | 280/824 |
| 4,582,341 | A * | 4/1986 | Erickson | 280/824 |
| 4,669,752 | A * | 6/1987 | Jackson et al. | 280/824 |
| 4,700,975 | A * | 10/1987 | Ehemann et al. | 280/824 |
| 4,900,061 | A * | 2/1990 | Kozma, Jr. | 280/813 |
| 6,015,165 | A * | 1/2000 | Artemis et al. | 280/824 |
| 6,203,063 | B1 * | 3/2001 | Bujold et al. | 280/819 |
| 6,203,064 | B1 * | 3/2001 | Zaltron | 280/824 |
| 7,172,219 | B2 * | 2/2007 | Spragg et al. | 280/823 |
| 7,992,900 | B2 * | 8/2011 | Jacobs | 280/809 |
| 2008/0169012 | A1 * | 7/2008 | Gillanders | 135/84 |
| 2009/0028640 | A1 * | 1/2009 | Menzel et al. | 404/10 |
| 2009/0273173 | A1 * | 11/2009 | Jacobs | 280/821 |
| 2011/0018250 | A1 * | 1/2011 | Lenhart | 280/824 |

* cited by examiner

*Primary Examiner* — J. Allen Shriver, II
*Assistant Examiner* — Travis Coolman
(74) *Attorney, Agent, or Firm* — Bernd W Sandt

(57) ABSTRACT

The present invention relates to a basket for a ski pole at the tip of the pole, in which the basket comprises a disk of flexible rods, bristles or filaments extending from a hub and in which the hub contains a center opening for a ski pole shaft to be inserted. The rods, bristles or filaments extend from perpendicular to the shaft down to 45 degrees towards the tip of the pole.

8 Claims, 2 Drawing Sheets

SKI POLE BASKET

FIELD OF INVENTION

This invention relates to ski poles and more particularly to a basket for ski poles. It is particularly directed to ski poles used for backcountry touring.

STATE OF THE ART

Standard ski poles typically comprise a handle connected to a cylindrical shaft with a pointed tip and a basket attached to the bottom of the shaft. Traditional baskets consist of a peripheral hoop to which spokes have been fastened to a hub, which is attached to the ski shaft. Such baskets are well suited to skiing on groomed snow. Ski poles and baskets designed for the backcountry have removable baskets with a standardized coupler of the basket to the pole, so the pole can be used as an avalanche probe. However the disadvantage of this type of basket is that it has a tendency to catch and/or get caught by tree branches, bushes or other obstructions in the snow and particularly under the surface of the snow, while skiing in the backcountry. An entangled basket can strip the basket from the pole or strip the pole from the skier's hand and even pull the skier of balance causing him to fall.

SUMMARY OF THE INVENTION

This invention comprises a detachable basket for a ski pole into which the shaft of the pole is inserted, wherein the basket comprises a hub having a center hole with flexible longitudinal radial extensions in sufficient numbers to form an umbel. The term flexible is meant to indicate that the extension can be bent by the application of a force but will spring back to its original position when that force is released. The extensions forming the umbel are sufficiently flexible to move in either the horizontal or vertical direction to the surface of the umbel and yet are sufficiently rigid to support a skier moving through the snow. The longitudinal extensions can take the form of flexible filaments, bristles or rods and are employed in sufficient numbers and length to provide the desired support for the skier. The number and rigidity of such extensions, however, should not be so high as to prevent horizontal and vertical flexing to avoid being entangled by objects in the snow. In a preferred embodiment the basket comprises a hub with flexible filaments radially extending from the hub in sufficient numbers to form an umbel in which the hub contains an opening through which the shaft of the pole is attached to the basket. The type, number, length and diameter of the filament can vary but should be such that in combination such filaments provide the desired rigidity but also provide sufficient flexibility to avoid being entangled by obstructions in the snow. The size and shape of the umbel corresponds to sizes and shapes of baskets heretofore developed. Similarly methods employed heretofore to attach the basket to the pole, usually by means of a male and female coupler, can equally used with the basket of the present invention and generally involves a ferrule attached to the shaft with a mating ring on the basket.

DETAILED DESCRIPTION OF THE INVENTION

Figure 1:
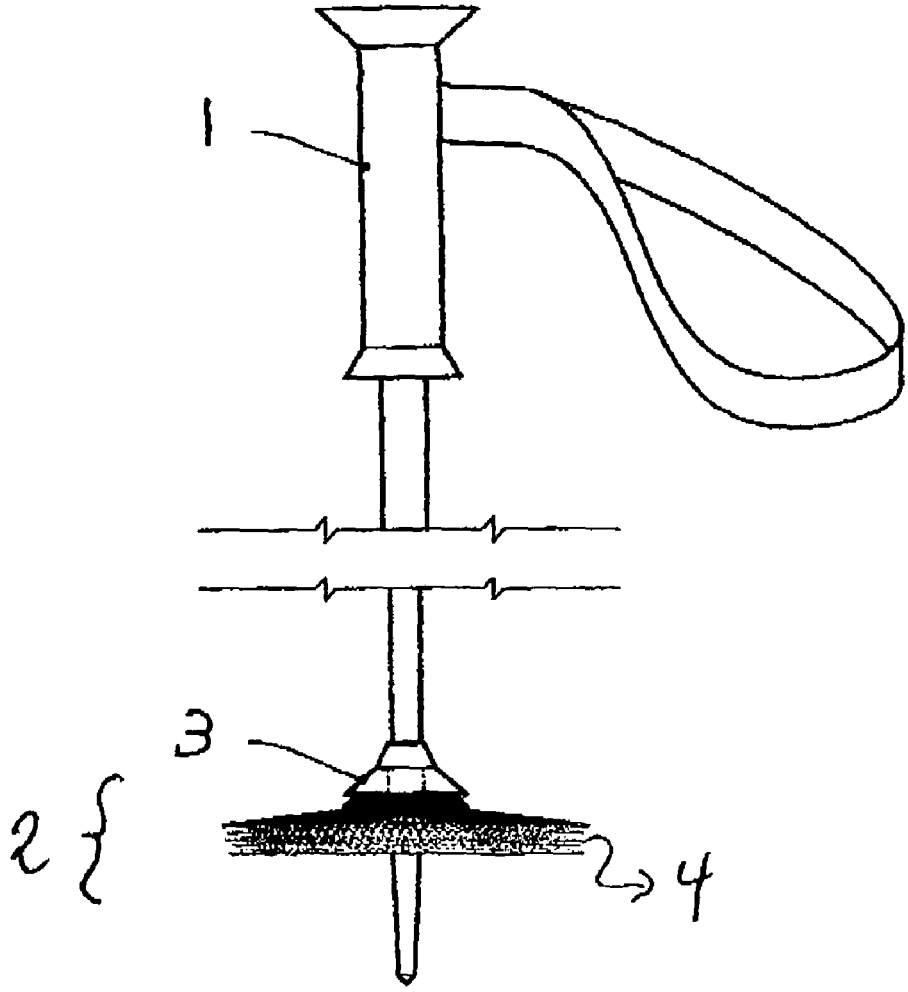
FIG. 1 shows a side view of the ski pole with the basket installed

FIG. 1 illustrates a preferred form of ski pole of the present invention showing the attachment of the basket 2 to the shaft

Figure 2:
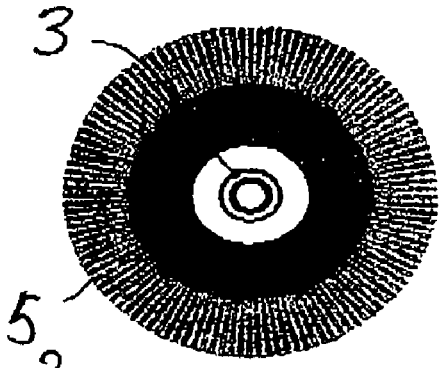
FIG. 2 shows a top view of the basket
Figure 3:
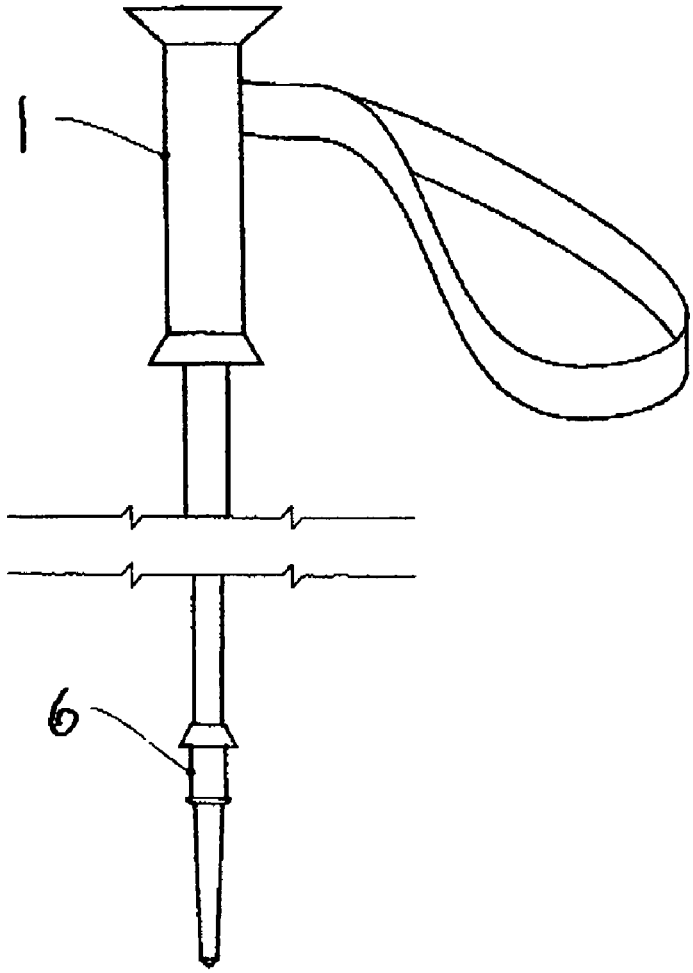
FIG. 3 shows a side view of the ski pole without the basket

1 of the ski pole. The basket itself, as shown in FIGS. 1 and 2, made up of a hub 3 and a sufficient number of flexible filaments 4 bound to the hub to form the umbel or disk 5. Although the umbel can be perpendicular to the pole, it is preferred to have the umbel surfaces be inclined towards the tip of the pole at an angle not in excess of 45 degrees. Generally speaking it has been found that the filaments should be long enough to form an umbel of 3.5 to 6" in diameter. The umbel when attached to the pole can be symmetric with all filaments having the same length or asymmetric with some filaments being shorter. The preferred filaments are hydrophobic, flexible to temperatures as low as −50° F. and are preferably made of a plastic material or coated with a plastic material. Preferred plastics are nylon, polyester or acrylic resins. In order for such filaments to have the desired degree of stiffness a particulate inert solid such as sand or silicon carbide can be incorporated into the filament. The diameter of the filament and the number of filaments used to form the umbel can vary to adjust to the individual skier and the snow conditions. In general the diameter of the filament will vary between 0.012 and 0.040" and the number of filaments from about 80 to 300.

Figure 4:
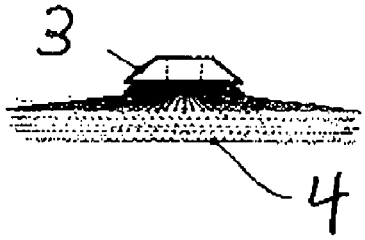
FIG. 4 shows a side view of the basket
Figure 5:
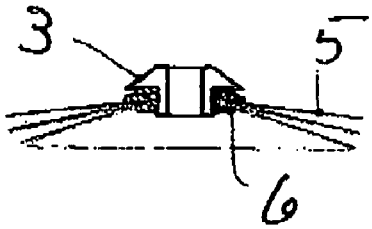
FIG. 5 shows a cross section of the basket

Backcountry ski poles on the market today have a male and a female coupler in which the male part is molded to the ski pole shaft in the form of a ferrule and the female part is molded to the basket in the form of a ring such that the pole shaft can be slipped into the opening of the ring and form a tight press fit of the basket to the pole. The same type attachment of the pole to the basket is also the preferred method of attaching the basket of the present invention to the shaft. FIG. 2 shows the ring 6 with the ferrule bonded to the shaft 1 of the ski pole in the form of a male and female coupler. The ferrule is located at the normal height of baskets from the tip of the ski pole, which generally is about 3 to 5" from the tip. FIG. 4 shows a side view of the umbel of filaments 4 attached to the ring 3 such that the ring fits the ferrule on the ski pole shaft in a press fit as can be done with the replaceable baskets known in the art. FIG. 5 is a cross section of basket showing the ring 3 and the hub 6 having bonded to it the filaments 4 forming the umbel 5.

The ski pole basket of the present invention has been described in terms of its preferred embodiment, but as will be apparent to those familiar with skiing in the backcountry, is not limited to such. Depending on the weight of the skier and the conditions of the snow the umbel might comprise flexible extensions in the form of rods having cross sections other than circular. Similarly the extensions may comprise a metal wire rather then a plastic filament. The extensions employed in the ski pole basket of the present invention may take any shape as long as such extensions provide sufficient flexibility in all direction to avoid being caught by obstructions in and under the surface of the snow coming in contact with the pole.

The invention claimed is:

1. A ski pole comprising a shaft, a tip, and a basket, said basket comprising radially arranged flexible bristles or filaments in sufficient number to form a disk, which are bound to a central hub having an opening for the shaft to be inserted into the basket, said bristles or filaments extending at an angle from perpendicular to the shaft down to an angle of 45° towards the tip of the pole, said basket being located in the vicinity of the tip of the pole.

2. The ski pole of claim 1 wherein the disk comprises flexible filaments.

3. The ski pole of claim 2 wherein the flexible filaments have a diameter of 0.012 to 0.04".

4. The ski pole of claim 3 wherein the filaments are made of a plastic material.

5. The ski pole of claim 4 wherein the filaments are nylon filaments.

6. The ski pole of claim 2 wherein the disk comprises from 80 to 300 filaments.

7. The ski pole of claim 1 wherein the disk has a diameter of 3.5 to 6".

8. The ski pole of claim 1 wherein the basket is removably attached to the shaft by interacting means of a male and female coupler.

* * * * *